US006160351A

United States Patent [19]

Han et al.

[11] Patent Number: 6,160,351

[45] Date of Patent: Dec. 12, 2000

[54] ILLUMINATION CONTROL APPARATUS FOR CONTROLLING ILLUMINATION BY DETECTING EXTERNAL MAGNETIC FIELD

[75] Inventors: Sung-hoo Han, Suwon; Sang-ug Kang, Sungnam, both of Rep. of Korea

[73] Assignee: Samsung Electronics Co., Ltd., Kyungki-Do, Rep. of Korea

[21] Appl. No.: 09/429,925

[22] Filed: Oct. 29, 1999

[30] Foreign Application Priority Data

Jul. 3, 1999 [KR] Rep. of Korea ..... 99-26741

[51] Int. Cl.[7] ..... H05B 37/00

[52] U.S. Cl. ..... 315/149; 315/151; 315/157; 340/540

[58] Field of Search ..... 340/540, 550; 315/149, 157, 151, 150

[56] References Cited

U.S. PATENT DOCUMENTS 4,901,053 2/1990 Kukamachi et al. ..... 340/426

*Primary Examiner*—David Vu

*Attorney, Agent, or Firm*—Sughrue, Mion, Zinn, Macpeak & Seas, PLLC

[57] ABSTRACT

An illumination control apparatus for controlling illumination by detecting a change in an environment is provided. The illumination control apparatus includes a magnetic field detector for detecting a change in a magnetic field generated by a magnetized ferroelectric object to output a first signal having a voltage which is proportional to the change in the magnetic field; an amplifier for amplifying the first signal; a discriminator for discriminating a level of the amplified voltage to output an illumination on-signal having a first logic level if the level of the amplified voltage is higher than a predetermined voltage, and otherwise to output an illumination off-signal having a second logic level; an illumination controller for outputting an illumination driving voltage in response to the illumination on-signal having the first logic level; and an illumination portion for producing light in response to the illumination driving voltage. Thus, the illumination control apparatus can turn illumination on/off by detecting the approach of a key in any locking system for use in, for example, the front door of a house, cars or office supplies, which requires that the key made of a ferroelectric material is magnetized. Also, the illumination control apparatus can control illumination in response to a specific action of a user and can be easily installed in a limited space.

10 Claims, 1 Drawing Sheet

ILLUMINATION CONTROL APPARATUS FOR CONTROLLING ILLUMINATION BY DETECTING EXTERNAL MAGNETIC FIELD

BACKGROUND OF THE INVENTION

1. Field of the Invention

The present invention relates to an illumination control apparatus, and more particularly, to an illumination control apparatus for controlling illumination by detecting an external magnetic field. The present application is based upon Korean Application No. 99-26741 filed on Jul. 3, 1999, which is incorporated herein by reference.

2. Description of the Related Art

In apparatuses for controlling illumination by detecting a change in the environment, automatic illumination has been achieved by detecting a person approaching an area using the reflection of ultrasonic waves or infrared rays. However, such conventional illumination control methods cannot control illumination according to a specific need of a user, and are not suitable for illumination in a restricted small area.

SUMMARY OF THE INVENTION

An object of the present invention is to provide an illumination control apparatus capable of controlling illumination in response to a specific action of a user.

According to an aspect of the present invention, there is provided an illumination control apparatus for controlling the turn-on and turn-off of illumination by detecting a change in an environment, comprising a magnetic field detector for detecting a change in a magnetic field generated by a magnetized ferroelectric object to output a first signal having a voltage which is proportional to the change in the magnetic field; an amplifier for amplifying the first signal; a discriminator for discriminating a level of the amplified voltage to output an illumination on-signal having a first logic level if the level of the amplified voltage is higher than a predetermined voltage, and otherwise to output an illumination off-signal having a second logic level; an illumination controller for outputting an illumination driving voltage in response to the illumination on-signal having the first logic level; and an illumination portion for producing light in response to the illumination driving voltage.

The magnetic field detector comprises a coil means for outputting an induced voltage proportional to the change in the magnetic field induced thereto as a first signal. The illumination control apparatus further comprises a light guiding element for guiding the produced light wherein the light is dispersed around a key boss. Preferably, the ferroelectric subject is a key, and the light guiding element is arranged to illuminate the peripheral region of the key boss.

BRIEF DESCRIPTION OF THE DRAWING

The above object and advantages of the present invention will become more apparent by describing in detail a preferred embodiment thereof with reference to the attached drawing in which.

DESCRIPTION OF THE PREFERRED EMBODIMENT

Figure 1:
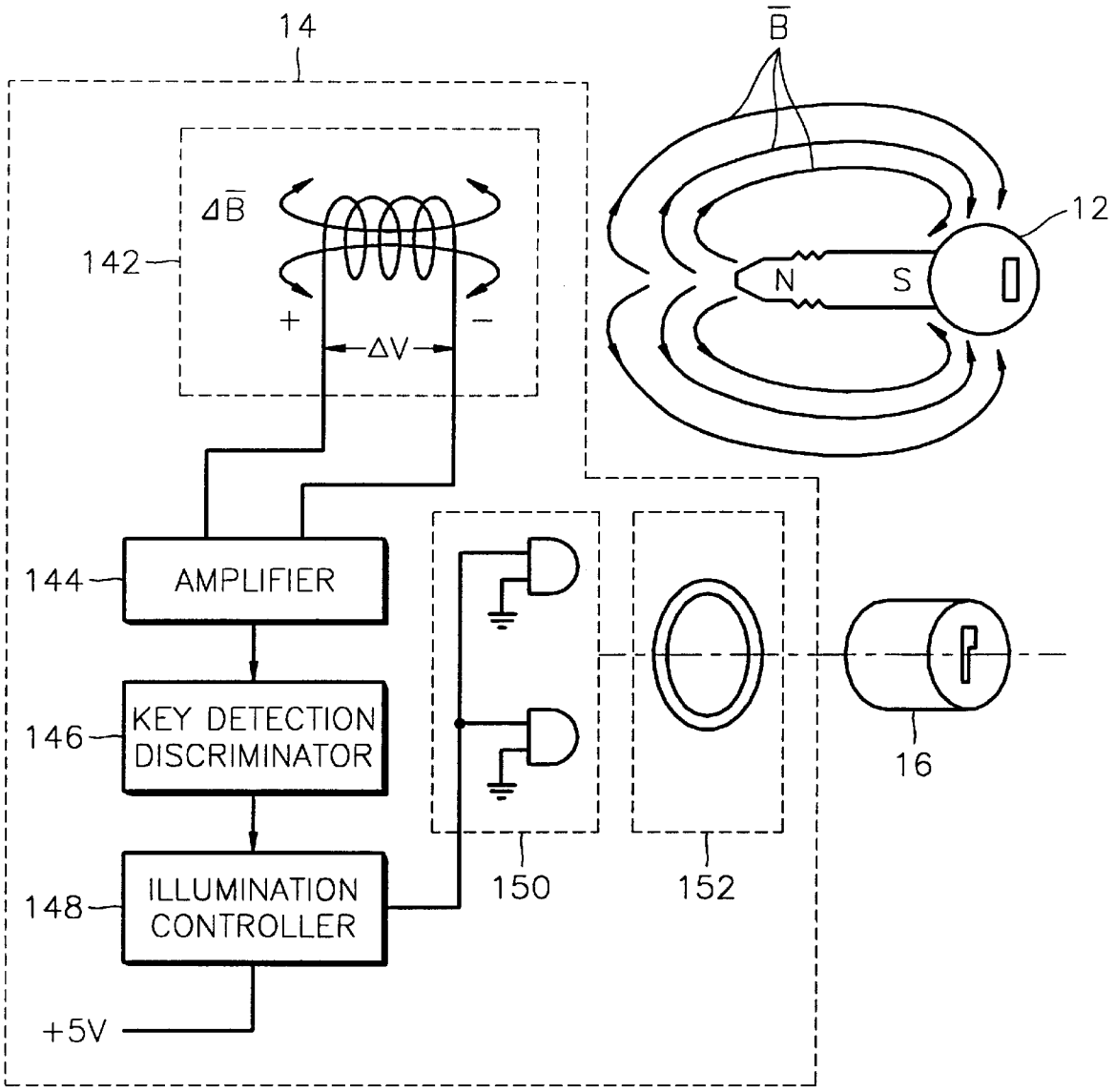
FIG. 1 is a block diagram showing the structure of an illumination control apparatus according to a preferred embodiment of the present invention.

Referring to FIG. 1, an illumination control apparatus 14 according to a preferred embodiment of the present invention comprises a magnetic field detector 142, an amplifier 144, a key detection discriminator 146, an illumination controller 148, an illumination portion 150 and a light guiding element 152.

In the operation of the illumination control apparatus, the magnetic field detector 142 includes a coil into which a magnetic field 0 generated by a magnetized key 12 is applied. Also, a voltage $\Delta V$, which is proportional to a change of the magnetic field which is induced in the coil $\Delta B$, is induced across both ends of the coil. Thus, the magnetic field detector 142 detects a change in the magnetic field B, which is produced with the approach of the key 12, and outputs the induced voltage $\Delta V$ as a first signal.

Because the level of the induced voltage is as low as several microvolts to several millivolts, the first signal must be amplified. The amplifier 144, such as an operational (OP) amplifier, amplifies the first signal. If the amplified voltage is higher than a predetermined level, the key detection discriminator 146 determines that the key 12 is near by, and outputs an illumination on-signal having a first logic level. Otherwise, the key detection discriminator 146 determines that the key 12 is not near by, and outputs an illumination off-signal having a second logic level.

Then, the illumination controller 148 receives a +5V external power voltage which is a high level, and outputs an illumination driving voltage having a transistor-transistor logic (TTL) level of 3V or more. The illumination portion 150 is turned on or off in response to the illumination driving voltage to emit light. The light guiding element 152, which is installed close to the illumination portion 150, is arranged in an annular shape, such that the light emitted from the illumination portion 150 is dispersed around a key boss 16 through the light guiding element 152. Thus, as a user brings the key 12 near the magnetic field detector 142, the key boss 16 is illuminated, thereby allowing the user to easily insert the key 12 into the key hole.

The illumination control apparatus causes illumination in response to a specific action of a user, for example, bringing a key near a key hole, when the key is magnetized. Thus, the illumination control apparatus according to the present invention can be applied to any locking system for use in, for example, the front door, cars or office supplies, which requires a key made of a ferroelectric material being magnetized. Also, the illumination control apparatus, which is installed at a portion near the key boss, can be easily installed in a limited space, compared to a conventional illumination apparatus which requires a high sensitivity to sense the human body itself.

While this invention has been particularly shown and described with reference to a preferred embodiment thereof where the object which produces a magnetic field is a key, it will be understood by those skilled in the art that various changes in form and details may be made therein without departing from the spirit and scope of the invention as defined by the appended claims, wherein for example, any object made of ferroelectric material which generates a relatively strong magnetic field when it is magnetized, may be used.

What is claimed is:

1. An illumination control apparatus for controlling illumination by detecting a change in an environment, comprising:

a magnetic field detector for detecting a change in a magnetic field, generated by a magnetized ferroelectric object to output a first signal having a voltage which is proportional to said change in said magnetic field;

an amplifier for amplifying said first signal;

a discriminator for discriminating a level of the amplified voltage to output an illumination on-signal having a first logic level if said level of said amplified voltage is higher than a predetermined voltage, and otherwise to output an illumination off-signal having a second logic level;

an illumination controller for outputting an illumination driving voltage in response to said illumination on-signal having said first logic level; and an illumination portion for producing light in response to said illumination driving voltage.

2. The illumination control apparatus of claim 1, wherein said magnetic field detector comprises a coil means for outputting an induced voltage proportional to said change in said magnetic field induced thereto as a first signal.

3. The illumination control apparatus of claim 1, further comprising a light guiding element for guiding the produced light wherein said light is dispersed around a key boss.

4. The illumination control apparatus of claim 1, wherein said ferroelectric object is a key.

5. The illumination control apparatus of claim 3, wherein said light guiding element is arranged to illuminate a peripheral region of said key boss.

6. An illumination control method for controlling illumination by detecting a change in an environment, comprising the steps of:

detecting a change in a magnetic field generated by a magnetized ferroelectric object to output a first signal having a voltage which is proportional to said change in said magnetic field;

amplifying said first signal;

discriminating a level of the amplified voltage to output an illumination on-signal having a first logic level if said level of said amplified voltage is higher than a predetermined voltage, and otherwise to output an illumination off-signal having a second logic level;

outputting an illumination driving voltage in response to said illumination on-signal having said first logic level; and producing light in response to said illumination driving voltage.

7. The illumination control method of claim 6, wherein said detecting step comprises a step of outputting an induced voltage proportional to said change in said magnetic field induced thereto as a first signal.

8. The illumination control method of claim 6, further comprising the step of guiding the produced light wherein said light is dispersed around a key boss.

9. The illumination control method of claim 6, wherein said ferroelectric object is a key.

10. The illumination control method of claim 8, wherein said guiding step is arranged to illuminate a peripheral region of said key boss.

* * * * *